United States Patent [19]

Ishida

[11] Patent Number: 4,509,496

[45] Date of Patent: Apr. 9, 1985

[54] IGNITION CIRCUIT FOR INTERNAL COMBUSTION ENGINE HAVING ALTERNATELY OPERABLE HIGH AND LOW SPEED CONTROL DEVICES

[75] Inventor: Shigetoshi Ishida, Narashino, Japan

[73] Assignee: Tanaka Kogyo Company, Ltd., Narashino, Japan

[21] Appl. No.: 452,210

[22] Filed: Nov. 22, 1982

[30] Foreign Application Priority Data

Dec. 29, 1981 [JP] Japan ..... 56-193830[U]

[51] Int. Cl.[3] ..... F02P 5/00

[52] U.S. Cl. ..... 123/651; 123/652

[58] Field of Search ..... 123/599, 644, 651, 652, 123/656

[56] References Cited

U.S. PATENT DOCUMENTS 3,841,288 10/1974 Korteling ..... 123/651
3,958,546 5/1976 Ohki et al. ..... 123/652
4,174,697 11/1979 Podrapsky et al. ..... 123/651
4,233,951 11/1980 Take ..... 123/651
4,342,304 8/1982 Watanabe ..... 123/651
4,356,808 11/1982 Bodig et al. ..... 123/644

*Primary Examiner*—Parshotam S. Lall
*Attorney, Agent, or Firm*—Frishauf, Holtz, Goodman and Woodward

[57] ABSTRACT

An ignition circuit for an internal combustion engine includes an ignition coil having a primary winding which is controlled by a power transistor. The lower transistor is controlled by either a first or a second control transistor. When the primary current flowing through the primary winding of the ignition coil is lower than a predetermined value, cut-off of the power transistor is controlled by the first control transistor. When the primary current is higher than the pre-determined value, cut-off of the power transistor is controlled by the second control transistor which becomes conductive prior to conduction of the first control transistor. Thus, two independent control means are alternately operated responsive to the primary current, which is a function of engine speed.

8 Claims, 1 Drawing Figure

IGNITION CIRCUIT FOR INTERNAL COMBUSTION ENGINE HAVING ALTERNATELY OPERABLE HIGH AND LOW SPEED CONTROL DEVICES

BACKGROUND OF THE INVENTION

The present invention relates to an ignition circuit for internal combustion engines, and more particularly it relates to an improvement on the induction dicharge type non-contact ignition circuit for internal combustion engines wherein the primary current passing through the primary winding of the magneto dynamo ignition coil is abruptly interrupted by the cutting-off of the power transistor in order to cause spark discharges in the spark plug which is connected to the secondary winding of said ignition coil.

Various types of induction discharge type non-contact ignition circuit for internal combustion engines utilizing transistor circuits have been developed and put into practical use. Although these circuits require no maintenance and/or inspection of the contact breaker and have been improved in respect of its durability, they are defective in that the stable spark discharge cannot be achieved unless the revolution rate of the magneto dynamo exceeds a certain rate since these circuits are constructed in such a way that the primary current is cut off when the same reaches a predetermined value.

More particularly, the internal combustion engines for such tools as chain saws are driven by manually pulling the recoiling rope for starting the same. The ignition circuit is therefore so set that when the revolution rate of about 750 rpm is obtained, the spark discharge sufficient for activation can be obtained. If the revolution rate is set too low, the ignition performance at the time of high speed driving becomes insufficient, and this naturally sets the lower limit. In case of the conventional ignition circuit of a contact breaker type, it was possible to confirm the spark discharge by lightly pulling the recoiling rope to check the functions of the ignition plugs. In case of the transistor type ignition circuits, on the other hand, the spark discharge cannot be performed when the recoiling rope is pulled at a strength which would normally give the revolution rate of about 300 to 500 rpm. It is necessary to pull the same at a still greater strength, causing confusion for operators who are used to handling the conventional contact breaker type circuits.

SUMMARY OF THE INVENTION

The present invention has been contrived in consideration of the aforementioned situation and aims to provide a novel transistor type ignition circuit which is capable of providing stable spark discharge at a higher revolution rate as well as cutting off the power transistor even at a lower revolution rate so as to enable the operator to check the spark discharge by pulling the recoiling rope as lightly as in the conventional contact breaker type circuits.

In the ignition circuit for internal combustion engines where primary current which passes through the primary winding of the magneto dynamo ignition coil is abruptly interrupted by the cutting off of the power transistor to thereby cause spark discharge in the ignition plug which is connected to the secondary winding of said ignition coil, the present invention circuit comprises and is characterized by a time constant circuit which includes a resistor and a capacitor, a first control transistor which becomes conductive by the electric charge provided by said primary current of said capacitor with the engine revolving at a rate lower than that determined by the time constant of said time constant circuit so as to cut off said power transistor at relatively lower revolution rates, and a second control transistor which becomes conductive when said primary current exceeds a predetermined value to thereby cut off said power transistor at relatively higher revolution rates than said lower revolution rates.

Said first control transistor becomes conductive when the primary current which shows gradual change in the relatively lower current range at the time of lower revolution rates is charged to the capacitor, and the charged voltage of the primary current exceeds the threshold level. In the meantime, the second control transistor is held cut-off if the primary current assumes such a low value.

On the other hand, as the revolution rate increases, the frequency of the primary current becomes shorter relative to the time constant of the time constant circuit. Therefore, as the value of the primary current exceeds the current value set for the second control transistor before the charge voltage level of the capacitor becomes high enough to make the first control transistor conductive, the second control transistor becomes conductive before the first; in this case the time constant plays substantially no role.

As the circuit of the present invention is controlled for cutoff of the power transistor by control transistors for lower and higher speed operations respectively, the spark discharge at the ignition plug can be obtained even if the recoiling rope is pulled lightly. Further, since this control transistor for lower speed operation does not function at higher rates of revolution, the ignition performance during the high speed operation can be maintained stable by the operation of the control transistor for high speed operation.

These and other objects and features of the present invention becomes apparent from the following description and the drawing which shows the preferred embodiment.

DESCRIPTION OF THE PREFERRED EMBODIMENT

Figure 1:
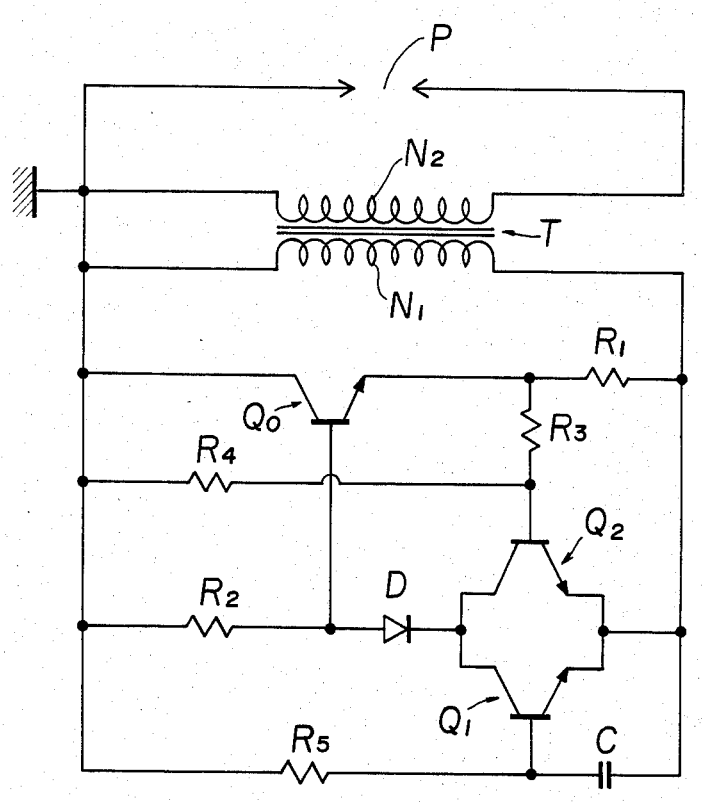
FIG. 1 shows the electrical circuit of the ignition circuit for internal combustion engines according to the present invention.
Figure 2:
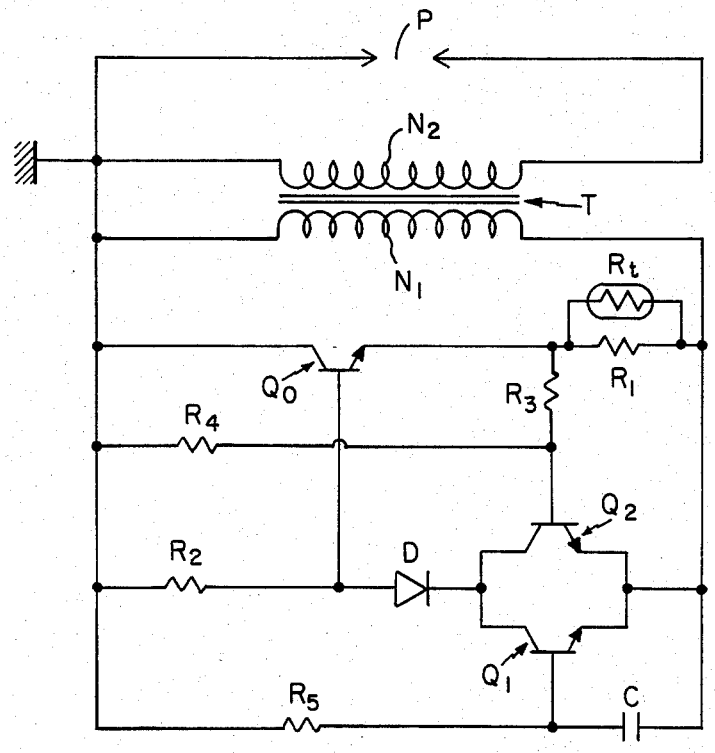
FIG. 2 shows a modification of the circuit of FIG. 1.

In FIGS. 1 and 2, the reference letter (T) denotes an ignition coil for magneto dynamo; ($N_1$) and ($N_2$) the primary and the secondary windings of said ignition coil (T) respectively; (P) the ignition plug connected to both ends of the primary winding ($N_2$); ($Q_0$) a power transistor; ($Q_1$) a first control transistor for low speed operation; ($Q_2$) a second control transistor for high speed operation; (D) a diode; (C) a capacitor; and ($R_1$), ($R_2$), ($R_3$), ($R_4$) and ($R_5$) are resistors respectively. The collector emitter circuit of the power transistor ($Q_0$) is connected between both ends of the primary winding ($N_1$) via the current detecting resistor ($R_1$). The primary current is passed through the closed circuit connecting the collector emitter of the primary winding ($N_1$) and the power transistor ($Q_0$) and the resistor ($R_1$), the primary current being generated by the revolution of the magneto dynamo which is connected to the crank shaft of the internal combustion engine. By abruptly intercepting the primary current by cutting off the power transistor ($Q_0$), high voltage pulse is induced at the secondary winding to thereby cause the spark discharge at the ignition plug (P). The power transistor ($Q_0$) may be Darlington connected power transistor which can be operated for conduction/cutoff by controlling the base current thereof. If a sufficient current amplification factor of the power transistor is made, a sufficient base current can be supplied by a small amount of primary current via the resistor ($R_2$). This, then, permits the collector-emitter to be held substantially as short-circuited. The first control transistor ($Q_1$) is made conductive by the electric charge of said capacitor (C) of the time constant circuit which comprises the resistor ($R_5$) and the capacitor (C). On the other hand, the second control transistor ($Q_2$) is made conductive by the voltage drop which occurs at both ends of the resistor ($R_1$) for detecting the current. A portion of the primary current is supplied to the time constant circuit. The capacitor is charged at the polarity shown while it is positive, and when it is negative the capacitor shows a tendency to be charged at the reverse polarity. The time constant of the time constant circuit which is determined by the values of the resistor ($R_5$) and the capacitor (C) is, for example, determined at a value corresponding to the engine rotation rate of less than 500 rpm for lower speed operation. That is, when the engine revolution rate is below this value set for lower speed operation, it is so designed that the potential of the capacitor (C) is charged for every cycle by the primary current which exceeds the threshold voltage of the base-emitter junction of the first control transistor ($Q_1$). While the engine is revolving at a rate higher than said predetermined rate for low speed operation, the second control transistor ($Q_2$) is made operative directly dependent on the value of the primary current passing through the resistor ($R_1$) before the potential of the capacitor (C) reaches said threshold voltage of said base-emitter within every cycle. This way, the second control transistor ($Q_2$) is made conductive at the primary current which corresponds to the optimum timing for the ignition at the desired high speed operation by selecting the constant of the resistors ($R_1$) and ($R_3$). It is noted that the resistor ($R_4$) is provided to secure conduction of the transistor ($Q_2$) and acts to hold the power transistor ($Q_0$) conductive even when the voltage drop at both ends of the resistor ($R_1$) extinguishes by the cutoff of the primary current due to the cutoff of the power transistor ($Q_0$). In order to compensate the changes of the threshold voltage in the base-emitter of the control transistor ($Q_2$) due to the ambient temperature change, it is preferable to connect temperature sensitive elements such as a thermistor ($R_t$) or the like in parallel with the resistor ($R_1$), as shown in FIG. 2.

Thus, the ignition circuit for an internal combustion engine according to the present invention maintains a stable ignition performance during the normal high speed operation without causing delays in its timing. It can also cause the spark discharge at the ignition plug even when the engine is revolving at a low speed by lightly pulling the recoiling rope in the conventional contact breaker type and thus causes no confusion for the operators.

What is claimed is:

1. In an ignition circuit for an internal combustion engine where a primary current passing through a primary winding is abruptly interrupted by cut-off of a power transistor to thereby cause spark discharge of the ignition plug connected to a secondary winding of said ignition coil, the improvement comprising:

a time constant circuit which includes a resistor ($R_5$) coupled to capacitor (C), said time constant circuit being coupled to said primary winding so that a portion of the primary current flows therethrough to charge said capacitor;

first and second control transistors ($Q_1$, $Q_2$) coupled to said power transistor and to said time constant circuit, said first control transistor ($Q_1$) being arranged to become conductive prior to said second control transistor responsive to the electrical charge of said capacitor (C) due to said flow of said portion of said primary current therethrough at a revolution rate of the engine below a rate determined by the time constant of said time constant circuit so as to operate to control cut-off of said power transistor only at relatively lower revolution rates of said engine; and said second control transistor ($Q_2$) being arranged to become conductive prior to said first control transistor when said electrical charge on said capacitor exceeds a predetermined value so as to operate to control cut-off of said power transistor only at relatively higher revolution rates exceeding said relatively lower revolution rates of the engine, said first control transistor being inoperative to cut-off said power transistor at said relatively higher revolution rates of said engine, and said second control transistor being inoperative to cut-off said power transistor at said relatively lower revolution rates of said engine.

2. An ignition circuit as claimed in claim 1 wherein said power transistor is a Darlington connected power transistor.

3. An ignition circuit as claimed in claim 1, wherein the collector emitter circuit of the power transistor is connected across said primary winding, a current detector resistor being connected between one end of said primary winding and the emitter of said power transistor; and wherein said second control transistor is rendered conductive by the voltage drop across said current detecting resistor.

4. An ignition circuit as claimed in claim 3, further comprising a temperature sensitive element connected in parallel with said current detector resistor to compensate for threshold voltage changes due to ambient temperature changes.

5. An ignition circuit as claimed in claim 4, wherein said temperature sensitive element comprises a thermistor.

6. An ignition circuit for an internal combustion engine comprising;

a magneto dynamo provided with a primary winding having two ends, and a secondary winding which has a greater number of windings that said primary winding;

an ignition plug connected across said secondary winding;

a power transistor having a collector which is connected to one end of said primary winding;

a first current detecting resistor connected between the emitter of said power transistor and the other end of said primary winding;

a resistor connected between the base and the collector of said power transistor;

a first control transistor having a collector which is connected to the base of said power transistor, and an emitter which is connected to said other end of said primary winding;

a second control transistor having a collector which is connected to the base of said power transistor, and an emitter which is connected to said other end of said primary winding, whereby said second control transistor is connected in parallel with said first control transistor;

a third resistor connected between the base of said second control transistor and the emitter of said power transistor;

a fourth resistor connected between the base of said second control transistor and said one end of said primary winding;

a capacitor connected between the base of said first control transistor and said other end of the primary winding; and a fifth resistor connected between said base of said first control transistor and said one end of said primary winding so as to constitute a time constant circuit with said capacitor;

said time constant circuit being dimensioned such that said first control transistor becomes conductive prior to said second control transistor so as to operate to control cut-off of said power transistor responsive to the electrical charge on said capacitor at relatively lower engine revolution rates which are below a rate determined by said time constant circuit dimensioning; and said second control transistor becoming conductive prior to said first control transistor when said electrical charge on said capacitor exceeds a predetermined value so as to operate to control cut-off of said power transistor at relatively higher engine revolution rates which are higher than said relatively lower revolution rates.

7. An ignition circuit as claimed in claim 6, further comprising a temperature sensitive element connected in parallel with said first current detecting resistor to compensate for threshold voltage changes due to ambient temperature changes.

8. An ignition circuit as claimed in claim 7, wherein said temperature sensitive element comprises a thermistor.

* * * * *

UNITED STATES PATENT AND TRADEMARK OFFICE

CERTIFICATE OF CORRECTION

PATENT NO. : 4,509,496

DATED : April 9, 1985

INVENTOR(S) : Shigetoshi ISHIDA

It is certified that error appears in the above-identified patent and that said Letters Patent is hereby corrected as shown below:

After the "Abstract", the words "8 Claims, 1 Drawing Figure" should read --8 Claims, 2 Drawing Figures--;

In the "Abstract", line 3, "lower" should be --power--;

Column 4, line 60 (claim 6), "that" should read --than--.

Signed and Sealed this

*Seventh* Day of *January 1986*

[SEAL]

*Attest:*

*Attesting Officer*

DONALD J. QUIGG

*Commissioner of Patents and Trademarks*